US009398799B2

(12) United States Patent
Chang

(10) Patent No.: US 9,398,799 B2
(45) Date of Patent: Jul. 26, 2016

(54) DOUBLE-LAYERED SCREEN CAP OF A COSMETICS CONTAINER

(71) Applicant: Jeng Wuei Plastics Industrial Co., Ltd., Taichung (TW)

(72) Inventor: Sam Chang, Taichung (TW)

(73) Assignee: JENG WUEI PLASTICS INDUSTRIAL CO., LTD., Taichung (TW)

( * ) Notice: Subject to any disclaimer, the term of this patent is extended or adjusted under 35 U.S.C. 154(b) by 0 days.

(21) Appl. No.: 14/335,547

(22) Filed: Jul. 18, 2014

(65) Prior Publication Data

US 2016/0015148 A1 Jan. 21, 2016

(51) Int. Cl.

| | |
|---|---|
| ***B65D 69/00*** | (2006.01) |
| ***A45D 33/16*** | (2006.01) |
| ***A45D 33/00*** | (2006.01) |
| ***A45D 33/24*** | (2006.01) |
| *A45D 40/22* | (2006.01) |

(52) U.S. Cl.

CPC ..... *A45D 33/16* (2013.01); *A45D 33/006* (2013.01); *A45D 33/24* (2013.01); *A45D 40/22* (2013.01)

(58) Field of Classification Search

CPC ..... A45D 33/16; A45D 2200/1018; A45D 33/00; A45D 40/24; A45D 33/006; A45D 33/025

USPC ..... 206/581

See application file for complete search history.

(56) References Cited

U.S. PATENT DOCUMENTS

| | | | | |
|---|---|---|---|---|
| 5,975,368 | A * | 11/1999 | Wood | A47G 19/24 222/151 |
| 8,025,067 | B2 * | 9/2011 | Thorpe | A45D 33/003 132/307 |
| 2007/0228079 | A1 * | 10/2007 | Vogel | B65D 47/0838 222/151 |
| 2013/0068801 | A1 * | 3/2013 | Lai | A45D 33/16 222/565 |
| 2014/0231304 | A1 * | 8/2014 | Lee | A45D 33/006 206/581 |

* cited by examiner

*Primary Examiner* — Shawn M Braden

(74) *Attorney, Agent, or Firm* — Ming Chow; Sinorica, LLC

(57) ABSTRACT

A double-layered screen cap of a cosmetics container includes a lower cap and an upper cap pivotally connected together by a connecting unit. The lower cap is bored with a plurality of insert holes, and the upper cap is provided with a plurality of projections corresponding with the insert holes. Thus, when the upper cap is covered on the lower cap, the projections of the upper cap will be respectively and correspondingly inserted in the insert holes of the lower cap to hermetically seal the insert holes for restrictedly positioning the cosmetic material in the cosmetics container, able to prevent the cosmetic material from leaking out of the cosmetics container.

8 Claims, 9 Drawing Sheets

DOUBLE-LAYERED SCREEN CAP OF A COSMETICS CONTAINER

BACKGROUND OF THE INVENTION

1. Field of the Invention

This invention relates to a screen cap, particularly to a double-layered screen cap applied to a cosmetics container.

2. Description of the Prior Art

A conventional cosmetics container, as shown in FIG. 1, includes a bottle 1, a screen cap 2 covered on the opening of the bottle 1 and bored with a plurality of insert holes 3, a transparent sticker 4 stuck to a location corresponding with the insert holes 3 of the screen cap 2 and a cover 5 covered around the outer side of the screen cap 2. Thus, cosmetic material, such as loose powder and the like, can be filled into the bottle 1 and then the screen cap 2 and the cover 5 are orderly covered. In using, firstly, tear off the transparent sticker 4 and then, shake the bottle 1 and control the amount of the cosmetic material needed for use to pass through the insert holes 3 and get to the screen cap 2 and at this time, a user can employ a powder puff to touch the cosmetic material for carrying out making up.

However, after a user finishes applying cosmetics, since the transparent sticker 4 is apt to touch the cosmetic material and lose viscosity; therefore, the transparent sticker 4 can no longer adhere to the screen cap 2 and hermetically seal the insert holes 3. As a result, when a user carries along such a conventional cosmetics container, the cosmetic material in the cosmetics container can freely pass through the insert holes 3 to touch and soil the cover 5 and further, when a user opens the cover 5, cosmetic material is easy to sprinkle out of the cosmetics container.

To improve the defects of the first conventional cosmetics container, a second conventional cosmetic container, as shown in FIG. 2, is to have the insert holes 3 provided at one side of the screen cap 2 and to employ a rotary cover 6 to substitute for the transparent sticker 4, and the rotary cover 6 is eccentrically provided with an opening 7 at a location aligned to the insert holes 3. In using, only turn around the rotary cover 6 to let the opening 7 aligned to the insert holes 3 and thus the cosmetic material can be obtained for use, and when the cosmetic material is not in use, the rotary cover 6 is turned around again to let the opening 6 and the insert holes staggered for restrictedly positioning the cosmetic material in the bottle 1.

Although foresaid improved screen cap can restrictedly position the cosmetic material in the bottle 1 yet, to enable the rotary cover 6 to be turned around, a certain gap may be formed between the rotary cover 6 and the screen cap 2 and hence, the cosmetic material is still apt to get out of the insert holes 3, pass through the gap and come out of the rotary cover 6. Therefore, the inventor of this invention thinks that the conventional screen cap of the cosmetics container has to be ameliorated and hence devises this invention.

SUMMARY OF THE INVENTION

The objective of this invention is to offer a double-layered screen cap of a cosmetics container, able to completely seal up the insert holes of the screen cap and surely restrict and position the cosmetic material in a cosmetics container for preventing the cosmetic material from getting out of the cosmetics container.

The double-layered screen cap of a cosmetics container in the present invention includes a lower cap and an upper cap pivotally connected together by a connecting unit. The lower cap is formed with a bottom wall having a circumferential edge extended upward and formed with an annular wall, having an accommodating space enclosed between the bottom wall and the annular wall, and the bottom wall is bored with a plurality of insert holes. The upper cap to be covered on the accommodating space of the lower cap has an underside fixed with a plurality of projections corresponding to the insert holes of the bottom wall to be respectively and correspondingly inserted in the insert holes for sealing up the insert holes. The connecting unit is pivotally connected between the annular wall of the lower cap and a circumferential edge of the upper cap to enable the upper cap to be turned relative to the lower cap.

The double-layered screen cap of this invention can be assembled in a cosmetics container. The cosmetics container is formed with a bottle for receiving cosmetic material therein, and the double-layered screen cap is set in an opening of the bottle. Thus, when the upper cap is covered on the accommodating space of the lower cap, the projections of the upper cap will be respectively and correspondingly inserted in the insert holes of the lower cap to hermetically seal up the insert holes for restrictedly positioning the cosmetic material in the cosmetics container and prevent the cosmetic material from getting out of the cosmetics container.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
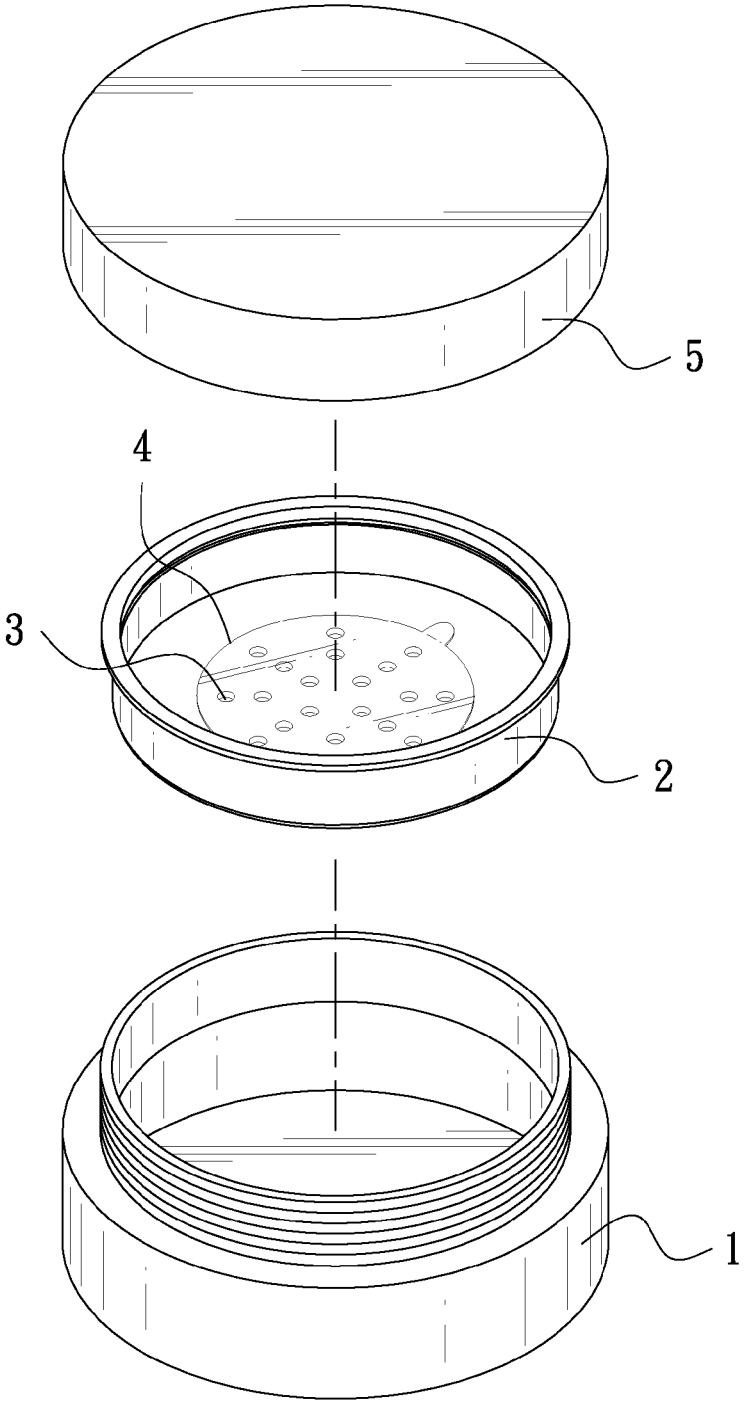
FIG. 1 PRIOR ART
FIG. 1 is an exploded perspective view of a conventional cosmetics container.
Figure 2:
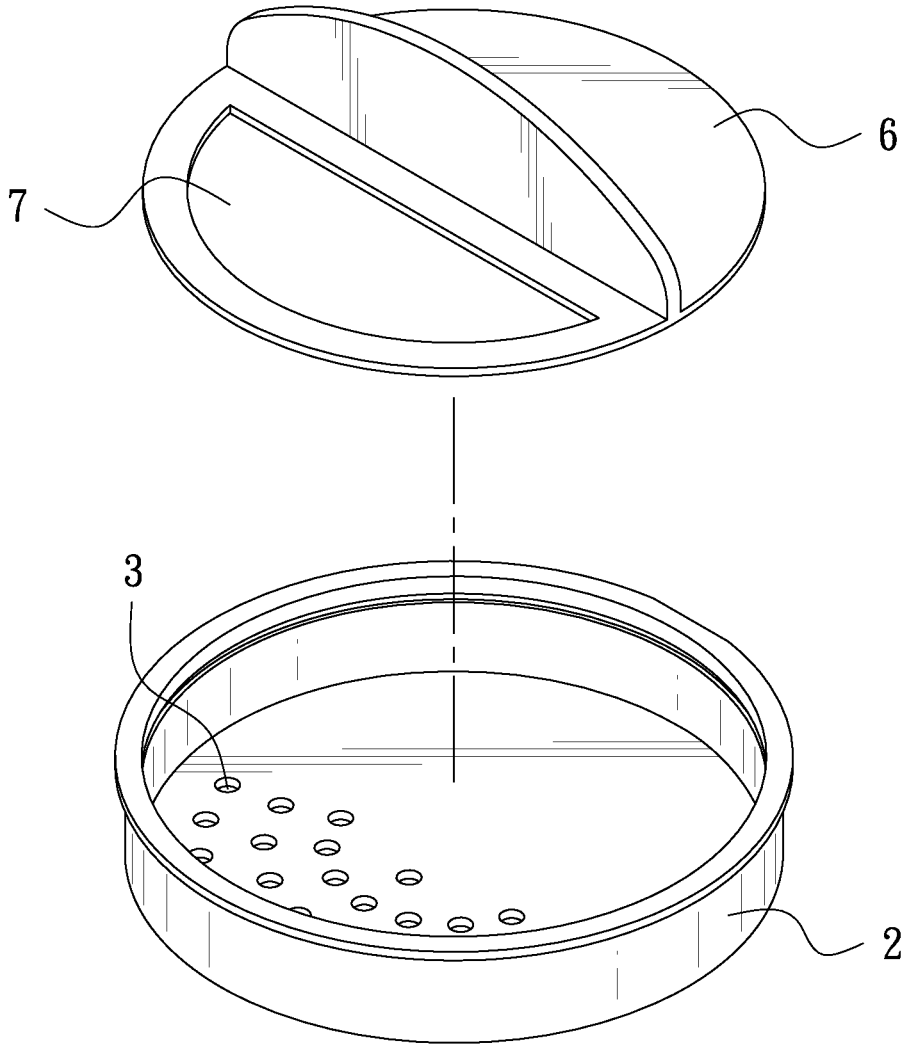
FIG. 2 PRIOR ART
FIG. 2 is an exploded perspective view of an improved screen cap of the conventional cosmetics container.
Figure 3:
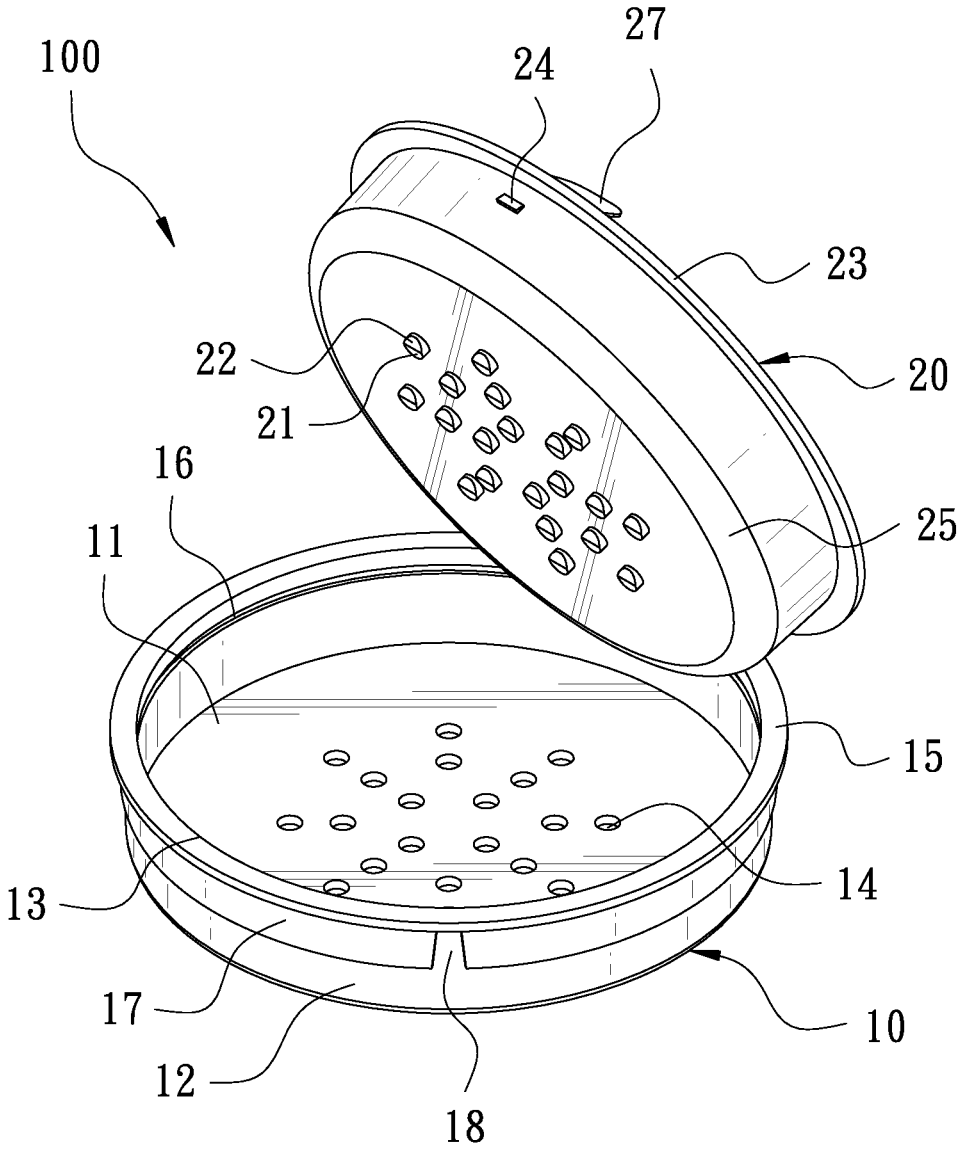
FIG. 3 is a perspective view of a first preferred embodiment of a double-layered screen cap of a cosmetics container in the present invention.
Figure 4:
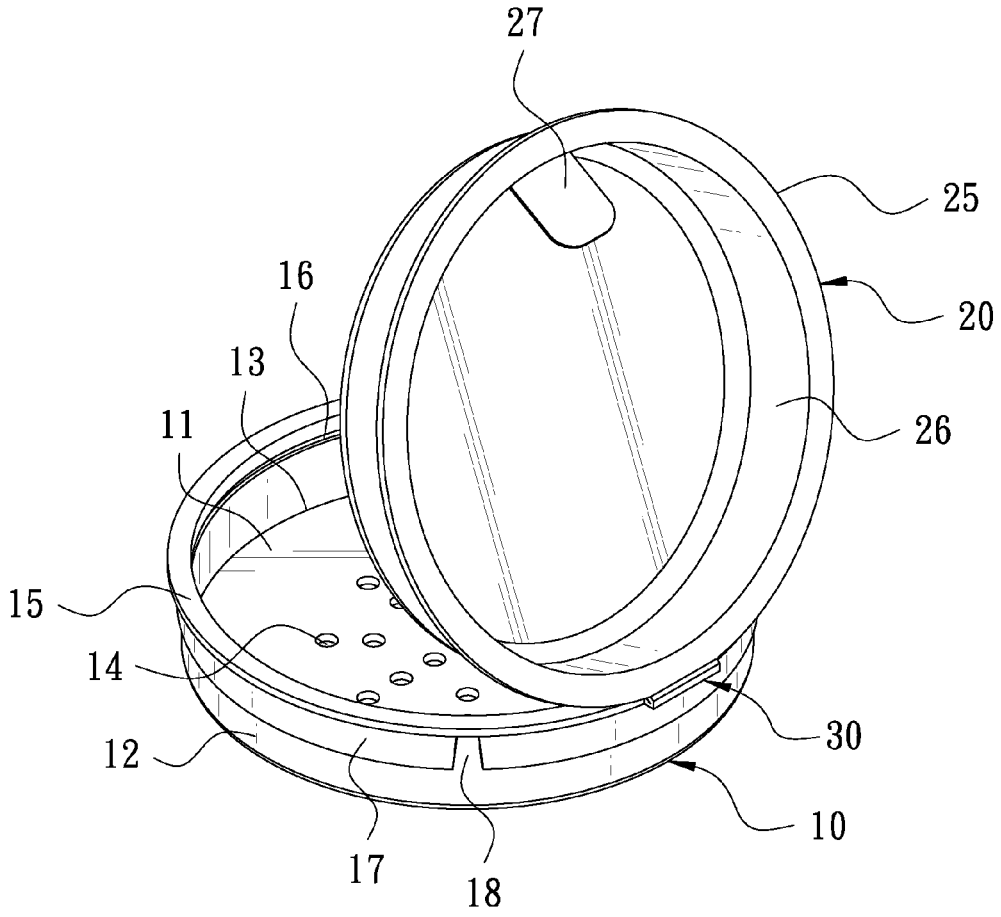
FIG. 4 is another perspective view of the first preferred embodiment of the double-layered screen cap of a cosmetic container viewed in another direction in the present invention.

A first preferred embodiment of a double layered screen cap 100 of a cosmetics container in the present invention, as shown in FIGS. 3 and 4, includes a lower cap 10, an upper cap 20 and a connecting unit 30 combined together.

The lower cap 10 is formed with a bottom wall 11 having its circumferential edge circularly provided with an annular wall 12, having an accommodating space enclosed between the bottom wall 11 and the annular wall 12, and the bottom wall 11 is bored with a plurality of insert holes 14. In this preferred embodiment, the insert holes 14 are arranged in a ※ shape and positioned at an intermediate portion of the bottom wall 11. The annular wall 12 has its top edge expanded outward to form a first stop lip 15, its inner side circularly provided with an annular engage recess 16 and its outer side disposed with a plurality of bulgy tightening blocks 17 spaced apart and having an air passageway 18 formed between every two tightening blocks 17.

The upper cap 20 to be covered on the accommodating space 13 of the lower cap 10 has its underside provided with a plurality of projections 21 corresponding to the insert holes 14 of the lower cap 10 to be respectively and correspondingly inserted in the insert holes 14 for sealing up the insert holes 14, and each projection 21 has a free end formed with a guide slant 22. Further, the upper cap 20 has a circumferential side provided with a second stop lip 23 corresponding with the first stop lip 15 of the lower cap 10, and an engage block 24 corresponding to the engage recess 16 so that the engage block 24 can be engaged with the engage recess 16 of the lower cap 10. Furthermore, the upper cap 20 has the circumferential edge of its underside annularly formed with a guide cambered surface 25 and has its topside recessed and formed with an accommodating groove 26 and also provided with a pull handle 27 at a location adjacent to the accommodating groove 26.

The connecting unit 30 is pivotally assembled between the annular wall 12 of the lower cap 10 and the circumferential edge of the upper cap 20 for movably connecting them together to enable the upper cap 20 and the lower cap 10 to be turned relatively. In this preferred embodiment, the connecting unit 30 is integrally connected between the first stop lip 15 of the lower cap 10 and the second stop lip 23 of the upper cap 20.

Figure 5:
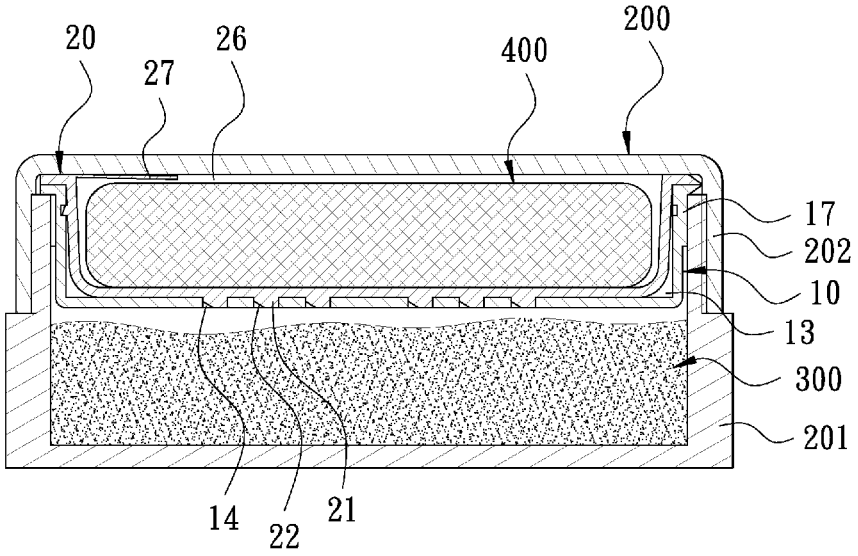
FIG. 5 is a cross-sectional view of the first preferred embodiment of the double-layered screen cap of a cosmetic container in a using condition in the present invention.

Referring to FIG. 5, the double-layered screen cap 100 is to be received in a cosmetic container 200, such as a face powder case. The cosmetics container 200 consists of a bottle 201 and a cover 202 covered on the opening of the bottle 201, and the double-layered screen cap 100 is positioned between the bottle 201 and the cover 202 of the cosmetic container 200. In using, firstly, cosmetic material 300 like loose powder is filled in the bottle 201 and then, the lower cap 10 is jammed in the opening of the bottle 201 and the upper cap 20 is covered on the lower cap 10, letting the upper cap 20 guided by the guide cambered surface 25 to be smoothly received in the accommodating space 13 of the lower cap 10. At this time, the projections 21 of the upper cap 20 will be respectively and correspondingly inserted in the insert holes 14 of the lower cap 10 to seal up the insert holes 14 for restrictedly positioning the cosmetic material 300 in the cosmetics container 200 and preventing the cosmetic material 300 from getting out of the cosmetics container 200. Lastly, a powder puff 400 is set in the accommodating groove 26 of the upper cap 20 and the cover 202 is covered on the bottle 201, thus finishing filling of the cosmetic material 300.

Figure 6:
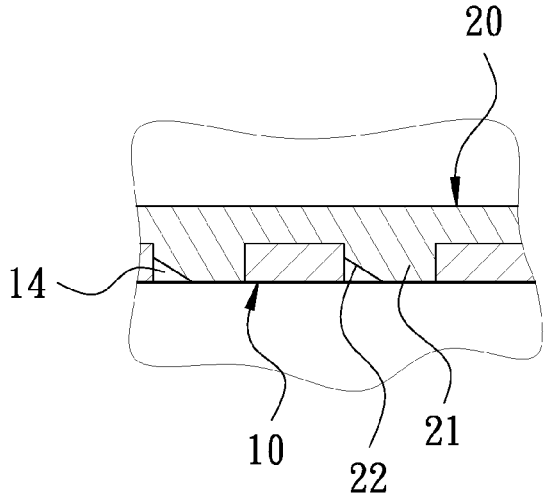
FIG. 6 is a partial magnified cross-sectional view of the location of a projection shown in FIG. 5.

Referring to FIG. 6, since the projections 21 of the upper cap 20 have their free ends respectively formed with a guide slant 22; therefore, when the upper cap 20 is covered on the lower cap 10 and received in the accommodating space 13 of the lower cap 10, the projections 21 can be guided by their guide slants 22 to be surely inserted in the corresponding insert holes 14 and the upper cap 20 can be smoothly covered on the lower cap 10.

Figure 7:
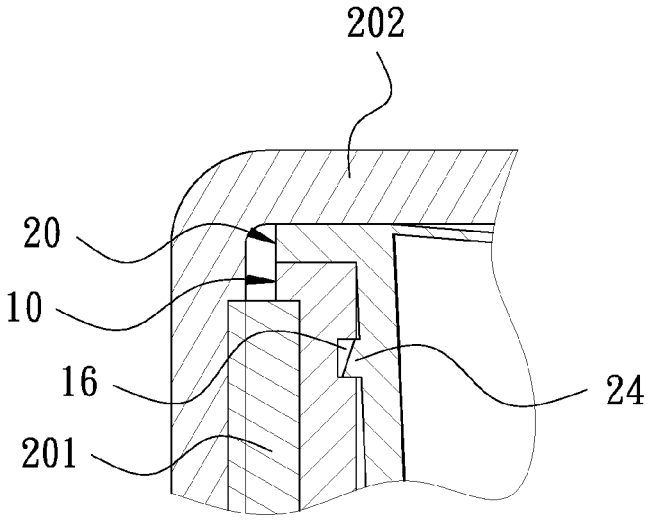
FIG. 7 is a partial magnified cross-sectional view of the location of an engage block shown in FIG. 5.

Referring to FIG. 7, the annular wall 12 of the lower cap 10 has its inner side circularly cut with the engage recess 16, while the upper cap 20 has its outer circumferential wall provided with the engage block 24 at a location corresponding to the engage recess 16; therefore, when the upper cap 20 is covered on the lower cap 10, the engage block 24 is able to be engaged with the engage recess 16, able to firmly fix the upper cap 20 and the lower cap 10 together. Thus, the upper cap 20 can be prevented from opening by itself when the cosmetics container 200 is bumped, and the projections 21 can be insured to be stably inserted in the insert holes 14 for hermetically sealing the insert holes 14.

Figure 8:
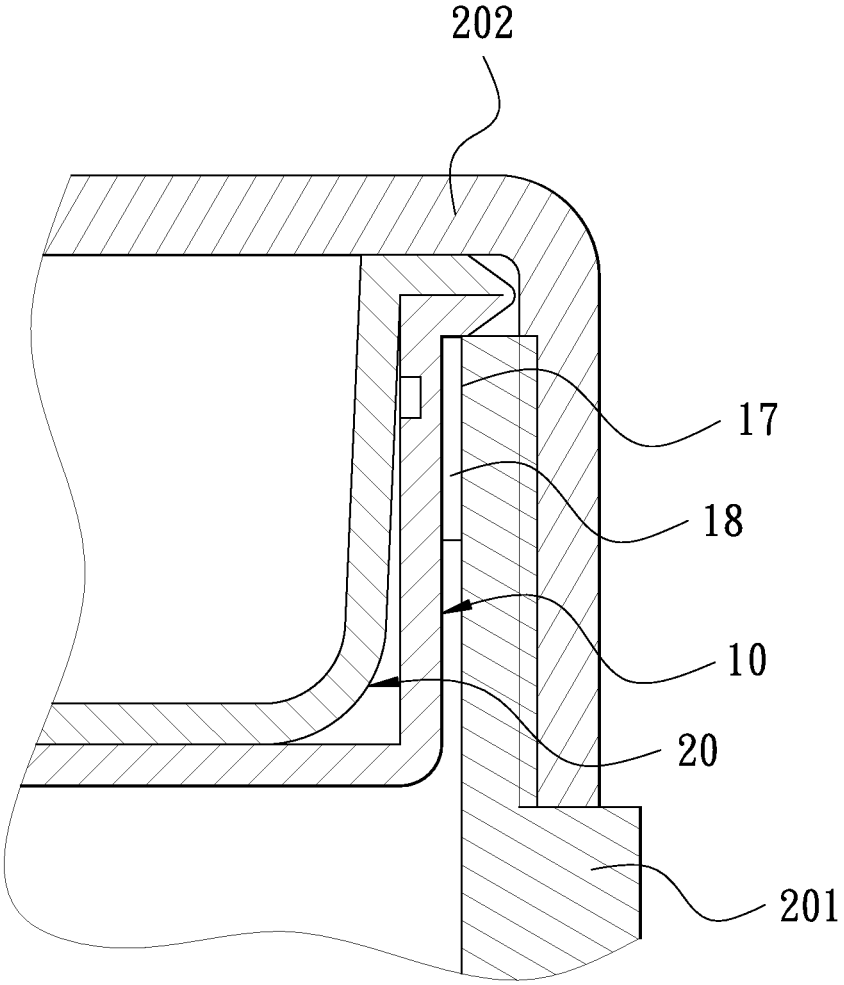
FIG. 8 is a partial magnified cross-sectional view of the location of an air passageway shown in FIG. 5.

Referring to FIG. 8, since the annular wall 12 of the lower cap 10 has its outer side provided with the plurality of bulgy tightening blocks 17 and the air passageway 18 is formed between every two tightening blocks 17; therefore, when the lower cap 10 is jammed into the opening of the bottle 201, the lower cap 10 can be tightly fastened to the inner wall of the bottle 201 by means of the tightening blocks 17, thus reinforcing fixation of the lower cap 10 in the bottle 201. In addition, in a course of jamming the lower cap 10 into the bottle 201, air in the bottle 201 can flow out of the bottle 201 via the air passageways 18 to enable the lower cap 10 to be smoothly set in the opening of the bottle 201.

Figure 9:
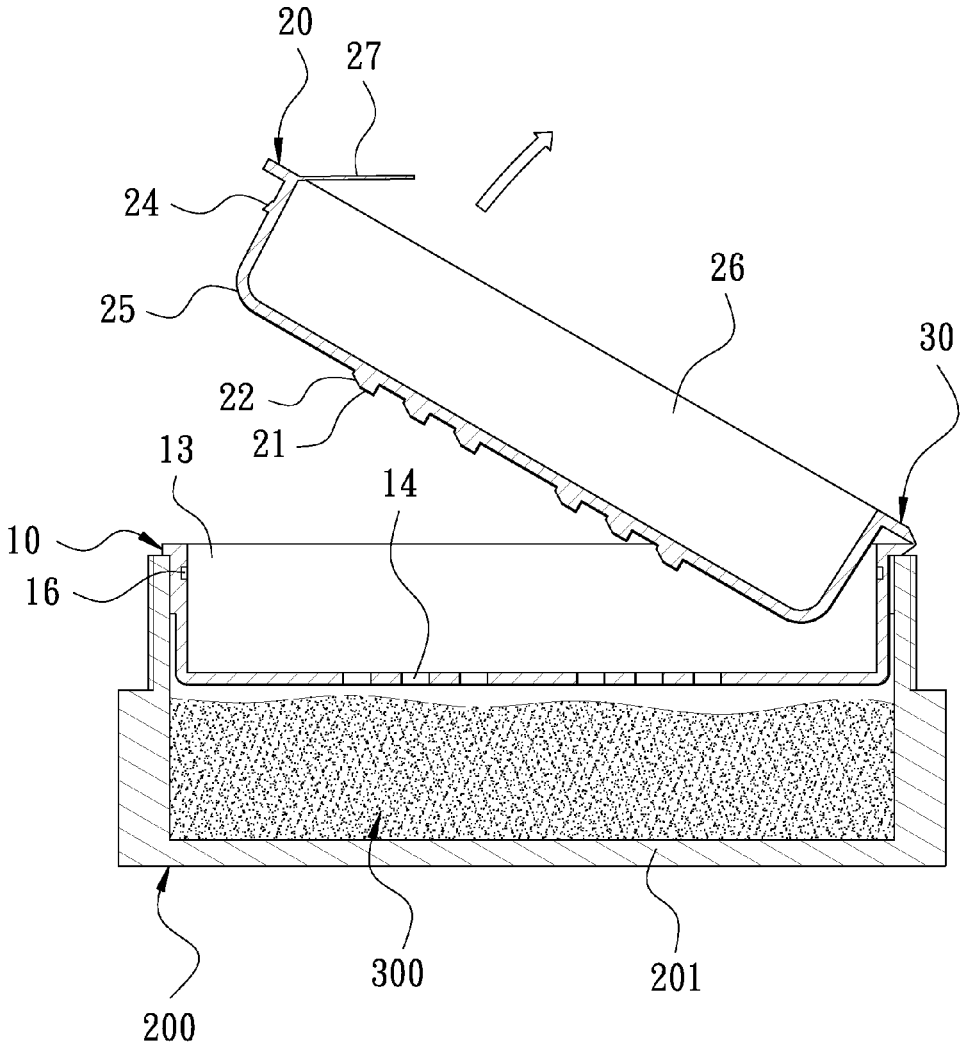
FIG. 9 is a schematic view of the first preferred embodiment of a double-layered screen cap of a cosmetics container in an operating condition in the present invention.

Referring to FIG. 9, to employ the cosmetic material 300 in the cosmetics container 200 to carry out making up, a user needs only to open the cover 202 and take out the powder puff 400 and then remove the upper cap 20 out of the accommodating space 13 of the lower cap 10 by the pull handle 27 to actuate the projections 21 to disengage from the insert holes 14. Subsequently, the bottle 201 is shaken to control the amount of the cosmetic material 300 needed for use to pass through the insert holes 14 and get into the accommodating space 13 of the lower cap 10 and at this time, the user can employ the powder puff 400 to touch the cosmetic material 300 for carrying out making up. Since the upper cap 20 and the lower cap 10 are pivotally connected together; therefore, in a course of applying cosmetics, it is unnecessary to additionally look for a place for storing the upper cap 20, thus not only preventing the upper cap 20 from losing, but also avoiding the upper cap 20 being soiled when the upper cap 20 is deposited at some other places.

Figure 10:
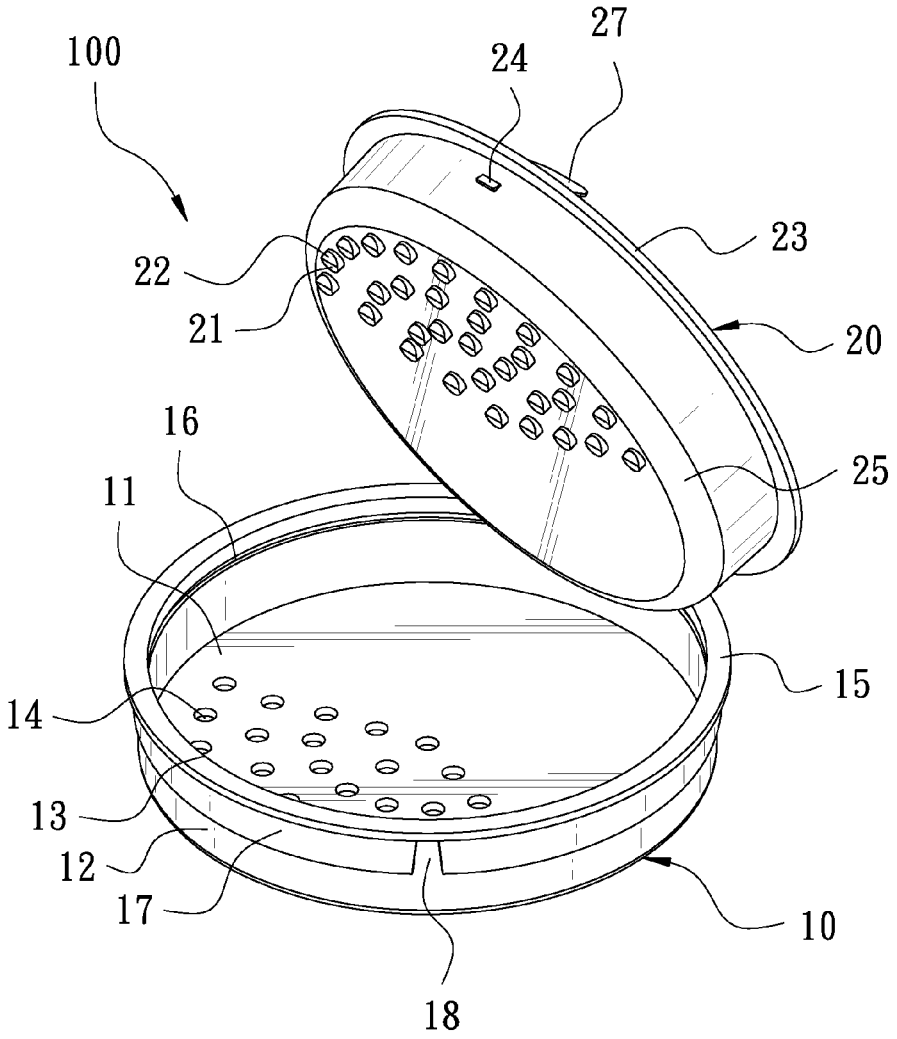
FIG. 10 is a perspective view of a second preferred embodiment of a double-layered screen cap of a cosmetics container in the present invention.

Since the insert holes 14 of the lower cap 10 in the first preferred embodiment is arranged in a ※ shape and positioned at an intermediate portion of the bottom wall 11; Therefore, when the bottle 201 is shaken, a great amount of cosmetic material 300 will come out of insert holes 14, but too much cosmetic material 300 is not suitable for a user who needs only a little cosmetic material 300 to fix her makeup. Therefore, a second preferred embodiment of a double-layered screen cap of a cosmetics container in the present invention, as shown in FIG. 10, is to have the insert holes 14 of the bottom wall 11 arranged in a semicircular shape and provided at one side of the bottom wall 11 to enable a user to get a small amount of cosmetic material 300 by obliquely shaking the bottle 201.

While the preferred embodiments of the invention have been described above, it will be recognized and understood that various modifications will be made therein and the appended claims are intended to cover all such modifications that may fall within the spirit and scope of the invention.

What is claimed is:

1. A double-layered screen cap of a cosmetics container comprising:

a lower cap formed with a bottom wall, said bottom wall having a circumferential edge extended upward to form an annular wall, an accommodating space enclosed between said bottom wall and said annular wall, said bottom wall bored with a plurality of insert holes;

an upper cap covered on said accommodating space of said lower cap, said upper cap having an underside provided with a plurality of projections corresponding with said insert holes, said projections respectively and correspondingly inserted in said insert holes for sealing up said insert holes;

a connecting unit pivotally connected between said annular wall of said lower cap and a circumferential edge of said upper cap, said upper cap able to be turned relative to said lower cap;

said projections of said upper cap respectively have a free end respectively provided with a guide slant; and said annular wall has an inner side circularly formed with an engage recess, while said upper cap has a circumferential side provided with an engage block, said engage block able to be engaged with said engage recess.

2. The double-layered screen cap of a cosmetics container as claimed in claim 1, wherein said annular wall has a top edge expanded outward to form a first stop lip, while said upper cap has a circumferential side formed with a second stop lip corresponding with said first stop lip, said connecting unit integrally connected between said first stop lip and said second stop lip.

3. The double-layered screen cap of a cosmetics container as claimed in claim 1, wherein said annular wall has an outer side disposed with a plurality of bulgy tightening blocks spaced apart, and an air passageway is formed between every two said tightening blocks.

4. The double-layered screen cap of a cosmetics container as claimed in claim 1, wherein said upper cap has a circumferential edge of an underside annularly provided with a guide cambered surface.

5. The double-layered screen cap of a cosmetics container as claimed in claim 1, wherein said upper cap has topside recessed and formed with an accommodating groove.

6. The double-layered screen cap of a cosmetics container as claimed in claim 1, wherein said upper cap has a top side extended and formed with a pull handle.

7. The double-layered screen cap of a cosmetics container as claimed in claim 1, wherein said insert holes are arranged in a ※ shape and positioned at an intermediate portion of said bottom wall.

8. The double-layered screen cap of a cosmetics container as claimed in claim 1, wherein said insert holes are arranged in a semicircular shape and positioned at one side of said bottom wall.

* * * * *